United States Patent [19]

Biddle

[11] 4,057,441

[45] Nov. 8, 1977

[54] SOLID PROPELLANT WITH BURNING RATE CATALYST

[75] Inventor: Richard A. Biddle, Newark, Del.

[73] Assignee: Thiokol Corporation, Newtown, Pa.

[21] Appl. No.: 678,523

[22] Filed: Apr. 20, 1976

[51] Int. Cl.[2] ..... C06B 45/10

[52] U.S. Cl. ..... 149/19.9; 149/19.4; 149/19.92; 149/19.1; 149/20; 149/21; 149/110

[58] Field of Search ..... 149/19.1, 19.9, 20, 149/21, 110, 19.4, 19.92

[56] References Cited

U.S. PATENT DOCUMENTS

| | | | |
|---|---|---|---|
| 3,305,523 | 2/1967 | Burnside | 149/19.9 X |
| 3,476,622 | 11/1969 | Harada et al. | 149/19.9 X |
| 3,753,348 | 8/1973 | Burnside | 149/19.9 X |
| 3,779,826 | 12/1973 | Shaver | 149/20 |
| 3,932,353 | 1/1976 | Mastrolia et al. | 149/19.9 X |
| 3,981,756 | 9/1976 | Gotzmer | 149/20 X |

OTHER PUBLICATIONS

Dean (ed.), "Lange's Handbook of Chemistry", 11th Ed., Section 4, p. 49, McGraw-Hill Book Co. (1973) New York.

*Primary Examiner*—Edward A. Miller
*Attorney, Agent, or Firm*—Stanley A. Marcus; Royal E. Bright

[57] ABSTRACT

Finely divided cupric sulfide increases the burning rate, and reduces the pressure exponent of solid propellant compositions.

5 Claims, No Drawings

SOLID PROPELLANT WITH BURNING RATE CATALYST

BACKGROUND OF THE INVENTION

The combustion of solid propellants is a progressive phenomenon localized on the surface of the propellant grain. The burning rate, assuming homogeneous ignition, is defined as the distance traveled per second by the flame front perpendicularly to the exposed surface of the grain.

The burning rate is dependent upon the pressure of the surrounding gas phase. The relationship may be expressed: $r = K \times P^n$ wherein $r$ is the burning rate, $K$ is a proportionally constant, $P$ is the absolute pressure and $n$ is the pressure exponent. It is apparent that when $n$ is positive, increase in pressure will lead to increased burn rate and that the greater $n$ is, the greater will be the increase in $r$ for a given rise in $P$.

A propellant with a high burning rate expells a larger amount of gases in a given period of time than a slower burn rate propellant. The result is a higher mass flow rate to perform a desired function.

A catalyst is frequently used to transform a slower burning propellant into a faster burning one. A wide variety of catalytic materials are known to be useful for control of burning rate. Typical of these are materials such as iron oxide, ferrocene, copper oxide, copper chromite, various organometallic compounds, carborane and various carborane derivatives.

It is frequently advantageous to reduce the pressure exponent of a propellant so as to reduce the fluctuation in pressure caused by a change in burn rate induced, for example, by irregularity in manufacture of the propellant grain. A low pressure exponent normally is indicative of a low temperature sensitivity characteristic, and therefore has less effect on pressure with changes in temperature where the burning is conducted in a combustion chamber from which the combustion products are exhausted, as in a rocket.

While none of the above mentioned burn rate catalysts are known to have the ability to also reduce the pressure exponent, the catalyst of the instant invention possesses this property in both aluminized and non-aluminized solid composite propellants.

SUMMARY OF THE INVENTION

The invention sought to be patented in its principal composition aspect resides in the concept of a solid propellant composition which comprises a binder component, an inorganic oxidizer component, and finely divided cupric sulfide.

The tangible embodiments of the principal composition aspect of the invention possess the inherent applied use characteristics of being gas producing compositions suitable for use in rocket propulsion and gas generators and having enhanced burn rates, and stable burn characteristics.

The invention sought to be patented in its sub-generic composition aspect of the principal composition aspect of the invention resides in the concept of a solid propellant composition which comprises a binder component, an inorganic perchlorate oxidizer component and a finely divided cupric sulfide component.

The invention sought to be patented in a second sub-generic composition aspect of the principal composition aspect of the invention resides in the concept of a solid propellant composition comprising a binder component, an inorganic perchlorate oxidizer component, and a finely divided cupric sulfide component wherein said finely divided cupric sulfide is of an average particle size of about $4\mu$.

The invention sought to be patented in its principal process aspect resides in the concept of a process for increasing the burn rate and reducing the pressure exponent of a solid propellant composition comprising a binder component and an oxidizer component, which comprises incorporating into said propellant composition, in need thereof, during its formulation an effective amount of finely divided cupric sulfide.

DESCRIPTION OF THE PREFERRED EMBODIMENT

The propellant compositions may be prepared by methods well known in the art. For example, the binder, plasticizer and burn rate catalyst may be blended in a mixer in the order listed, after which the inorganic oxidizer may be added in increments and mixing continued until uniformity is achieved. The curing agents, cross-linking agents or other additives generally may be added and thoroughly blended with the mix just prior to casting into a suitable mold or rocket motor. If desired, the last part of the mixing operation and the casting operation may be performed under vacuum to avoid air entrapment leading to voids in the propellants. Conveniently, when hydroxy terminated polybutadiene is the binder the temperature of the mix is maintained at about 140° F to 160° F so as to maintain a satisfactory viscosity during mixing and casting procedures. This temperature range of course, is not critical, any one skilled in the art would readily be able to adjust the temperature of any particular mix to attain a suitable viscosity.

The exact order of addition of the cupric sulfide burn rate catalyst is, of course, not especially critical. Preblending with the liquid binder is a preferred method because it is convenient and assures a complete dispersion of the cupric sulfide. The catalyst may also be added at the same time as or subsequent to the addition of the oxidizer.

Hydroxyl terminated polybutadiene based binders are convenient for use in these propellant systems. Illustrative of material suitable for this type of binder is the liquid resin R45M supplied by Arco Chemical Company. Other binder materials will also be suitable. Illustrative of these are, carboxy or epoxy terminated polybutadiene, copolymers such as polybutadiene acrylic acid, or polybutadiene acrylic acid acrylonitrile, asphalt and pitches including natural asphalt having a 170° F softening point, air blown asphalt having a 270° F softening point, mixtures of asphalt and synthetic or natural rubber, pitch having a 240° F softening point, mixtures of pitch and rubber, epoxy resins such as Araldite 502 and Epon 834, other liquid polymers such as polybutene, polyisobutylene, liquid polysulfide polymers, polyethylene, rubbers both natural and synthetic, such as butyl rubber, ethylacrylate methlvinylpyridine copolymers, waxes, both natural and synthetic, having a melting point within the range of 150° F to 300° F, synthetic resins and plastics, such as the various acrylic and polyvinyl resins, and nitro polymers such as polynitromethylmethylacrylate, nitropolybutadiene, and polynitrovinyl alcohols.

Where required, conventional curing agents are selected and employed to effect cure of the binder. For example, polyisocyanates are employed to cure hydroxy or epoxy terminated resins, and diaziridines, triaziridines, diepoxides, triepoxides and combinations thereof readily effect cures of carboxyl terminated resins. Normally an amount of curing agent up to about 2% by weight of all the combined propellant ingredients is sufficient for curing. The selection of the exact amount of curing agent for a particular propellant combination will be within the skill of one experienced in the art and will depend, of course, upon the particular resin, the curing time, the curing temperature, and the final physical properties desired for the propellant.

Oxidizers which are applicable in the solid propellant compositions of this invention are those oxygen-containing solids which readily give up oxygen and include, for example, ammonium, alkali metal, or alkaline earth metal salts of nitric, perchloric, and chloric acids, and nitramines. Ammonium nitrate and ammonium perchlorate are the preferred oxidizers for use in the solid propellants of this invention. Other specific oxidizers include sodium nitrate, potassium perchlorate, lithium chlorate, calcium nitrate, barium perchlorate, and strontium chlorate. Mixtures of oxidizers are also applicable. In the preparation of the solid propellant compositions, the oxidizers are ground to a particle size, preferably within the range between 20 and 200 microns average particle size. The most preferred particle size is from 40 to 60 microns. The amount of solid oxidizer used is usually a major amount of the total composition and is generally in the range between 50 and 85% by weight of the total propellant composition. If desired, however, the oxidizer can comprise less than 50% by weight of the propellant composition, in some instances. In the case of compression-molded propellants, the propellant can contain 90% by weight and above of the oxidizer based on total composition. Thus, the oxidizer content of the propellant composition usually ranges from 50 to 90% by weight.

The finished binder may include various compounding ingredients. This it will be understood herein and in the claims that unless otherwise specified, or required by the general context, that the term "binder" is employed generically and encompasses binders containing various compounding ingredients. Among the ingredients which may be added is for example, a plasticizer such as dioctyl adipate, so as to improve the castability of the uncured propellant and its rheological properties after cure. The binder content of the propellant composition will usually range from about 8½ to 24% by weight.

Metallic fuels, such as, for example, finely divided aluminum, may, if desired, be incorporated into the propellant compositions. If present, they may range from about 5 to about 25% by weight of the total weight.

Flame coolants such as, for example, dihydroxyglyoxime may also be incorporated, if desired, for such uses as gas generator compositions.

The finely divided cupric sulfide may have average particle sizes ranging from about 3 to about 30μ. Fluid energy milled cupric sulfide having an average particle size of about 4μ is a preferred form. The exact amount of cupric sulfide incorporated into any particular composition will, of course, depend upon the particle size and such factors of any given composition such as the specific impulse, burn rate and pressure exponent. Typically the cupric sulfide will be present in the final composition at about 0.1 to about 1.0% by weight, preferably about 0.1 to 0.5% by weight.

The following examples further illustrate the best mode contemplated for the practice of the invention.

EXAMPLE 1

A solid propellant formulation based on hydroxyl terminated polybutadiene resin (Arco R45M) cured with isophorone diisocyanate using an 0.86 NCO/OH ratio, containing HX-752 (0.15%) having 14% binder content and 86% total solids, containing ammonium perchlorate oxidizer (75% 200μ average particle size and 25% ground to the average mean particle size indicated), containing varying percentages of cupric sulfide (4.3μ average particle size) and powdered aluminum as indicated in Table I are prepared, pressure cast into ¼ inch diameter soda straws, cured, treated on the outside surface after removal of the straw with a double coating of black enamel, conveniently Sherwin Williams, KEM Lustral Enamel, Gloss Black, x-rayed to determine void-free areas for burning rate measurement, and burned in a Crawford bomb at pressures of 500, 1000 and 2000 psig. At least triplicate data points were obtained for each pressure level for each composition. The data so obtained are used to calculate the K and $n$ for the burning rate equation set forth hereinabove. A correlation coefficient and one sigma limits for both calculated values were also obtained from each data set. The results are shown in Table I.

TABLE I

| % Al | Ground AP | % CuS Added | Correlation Coefficient | Rate at 1000 psia (in/sec) | $\pm\sigma r$ | Exponent | $\pm\sigma n$ |
|---|---|---|---|---|---|---|---|
| 0 | 12μ | 0 | 0.989 | 0.356 | 0.003 | 0.317 | 0.017 |
| | | 0.1 | 0.998 | 0.387 | 0.001 | 0.254 | 0.006 |
| | | 0.5 | 0.998 | 0.432 | 0.001 | 0.219 | 0.006 |
| | | 1.0 | 0.989 | 0.444 | 0.003 | 0.190 | 0.011 |
| | 2.4μ | 0 | 0.995 | 0.354 | 0.002 | 0.248 | 0.010 |
| | | 0.5 | 0.996 | 0.402 | 0.001 | 0.161 | 0.005 |
| 16 | 12μ | 0 | 0.986 | 0.327 | 0.004 | 0.348 | 0.021 |
| | | 0.1 | 0.982 | 0.349 | 0.003 | 0.271 | 0.017 |
| | | 0.5 | 0.954 | 0.386 | 0.005 | 0.231 | 0.024 |
| | | 1.0 | 0.943 | 0.390 | 0.006 | 0.219 | 0.027 |
| | 2.4μ | 0 | 0.989 | 0.339 | 0.003 | 0.333 | 0.017 |
| | | 0.5 | 0.992 | 0.356 | 0.002 | 0.238 | 0.011 |

Due to changes in exponent caused by the CuS additive a direct comparison of burning rate at one reference pressure is not entirely straightforward. If, however, one selects the 1000 psia level as the midrange value for this data and uses this pressure level for comparison, by expressing the change in burn rate as a percentage one can obtain the following expression illustrating the effect of the presence of cupric sulfide and of the change in particle size of a portion of the ammonium perchlorate:

| | % Change in Burning Rate at 1000 psia | | |
|---|---|---|---|
| | % CuS | 0% Al | 16% Al |
| (Ground AP=12 μ) | | | |
| | 0 | 0 | 0 |
| | 0.1 | +9 | +7 |
| | 0.5 | +21 | +18 |
| | 1.0 | +25 | +19 |
| (Ground AP=2.4 μ) | 0 | 0 | 0 |
| | 0.5 | +14 | +5 |

Similarly one can express the effect of the same two variables on the pressure exponent:

| | % CuS | 0% Al | 16% Al |
|---|---|---|---|
| (Ground AP=12 μ) | | | |
| | 0 | 0 | 0 |
| | 0.1 | −20 | −22 |
| | 0.5 | −31 | −34 |
| | 1.0 | −40 | −37 |
| (Ground AP=2.4 =) | 0 | 0 | 0 |
| | 0.5 | −35 | −29 |

EXAMPLE 2

Solid propellant formulations analogous to those of Example 1 except no powdered aluminum was employed were prepared, cast into straws and treated as in Example 1. 1% CuS of the particle sizes shown were incorporated into the compositions. The burn rate and pressure exponent for each are shown:

TABLE II

| Average Particle Size of CuS | Correlation Coefficient | Burning Rate at 1000 psia | ±1σ | Pressure Exponent | ±1σ |
|---|---|---|---|---|---|
| 30 microns | 0.985 | 0.405 | 0.004 | 0.270 | 0.017 |
| 4.3 | 0.981 | 0.437 | 0.004 | 0.244 | 0.017 |
| 3.3 | 0.978 | 0.451 | 0.005 | 0.246 | 0.020 |

EXAMPLE 3

Aluminized propellant compositions analogous to those to Example 1 are cast into 2 inch center perforate (nominal 1/2 pound propellant weight) rocket motors. At operating pressures between 400 and 1500 psia the data shown are obtained:

TABLE III

| | Burning Rate Expression | Area Ratio Expression |
|---|---|---|
| CONTROL (no CuS) | $r = 0.270\ (P_c/1000)^{0.309}$ | $K_n = 351\ (P_c/1000)^{0.649}$ |
| +1.0% CuS 3.3 microns | $r = 0.337\ (P_c/1000)^{0.199}$ | $K_n = 285\ (P_c/1000)^{0.802}$ |

The subject matter which Applicant regards as his invention is particularly pointed out and distinctly claimed as follows:

1. A solid propellant composition comprising a hydroxy terminated polybutadiene based binder component, an oxygen containing inorganic oxidizer component, and finely divided cupric sulfide.

2. The propellant composition of claim 1 wherein the inorganic oxidizer component is ammonium perchlorate.

3. The propellant composition of claim 1 wherein the cupric sulfide is of an average particle size of about 4μ.

4. The propellant composition of claim 2 wherein the cupric sulfide is of an average particle size of about 4μ.

5. A process for preparing a solid propellant composition having increased burning rate and a reduced pressure exponent, said propellant composition comprising a hydroxy terminated polybutadiene based binder component, and an oxygen containing inorganic oxidizer component, which comprises a. adding to and mixing with said propellant composition, while said propellant composition is in an uncured condition, from 0.1% to 1.0% of final propellant weight of finely divided cupric sulfide; and b. curing said uncured cupric sulfide containing propellant composition of step *a*.

* * * * *